US010294629B1

(12) United States Patent
Sivaraman et al.

(10) Patent No.: US 10,294,629 B1
(45) Date of Patent: May 21, 2019

(54) HOLDER FOR COUPLING A WORK IMPLEMENT TO A WORK VEHICLE

(71) Applicant: Deere & Company, Moline, IL (US)

(72) Inventors: Sathish Kumar S. Sivaraman, Pune (IN); Mohamad S. El-Zein, Bettendorf, IA (US); Hector Portillo, Monterrey (MX); Israel Priego, Augusta, GA (US); Hema V. Guthy, Pune (IN); Daniel Chapa, Monterrey (MX)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 15/981,499

(22) Filed: May 16, 2018

(51) Int. Cl.
*E02F 3/36* (2006.01)
*E02F 3/96* (2006.01)
*E02F 3/34* (2006.01)

(52) U.S. Cl.
CPC ..... *E02F 3/3631* (2013.01); *E02F 3/34* (2013.01); *E02F 3/96* (2013.01)

(58) Field of Classification Search
CPC ..... E02F 3/3631; E02F 3/3636; E02F 3/3604; E02F 3/3686
USPC ..... 403/321, 224; 172/272–275
See application file for complete search history.

(56) References Cited

U.S. PATENT DOCUMENTS 2,710,569 A * 6/1955 Altgelt ..... A01B 59/063 172/272
4,136,792 A * 1/1979 Wilson ..... E02F 3/3613 172/272
4,345,872 A * 8/1982 Arnold ..... E02F 3/3631 414/705
4,462,172 A * 7/1984 Caron ..... E01H 4/02 172/817
4,812,103 A * 3/1989 Cochran ..... E02F 3/3631 172/272
4,850,789 A * 7/1989 Zimmerman ..... B66F 9/061 414/703
4,854,814 A * 8/1989 Smith ..... E02F 3/3622 414/723
5,060,463 A * 10/1991 Jones ..... A01B 59/048 172/273

(Continued)

OTHER PUBLICATIONS

Frost Supply, Conduit & Raceway Fittings Bushings Insuliner Sleeve/Adjustable Throat Liner Nylon, 2018.

*Primary Examiner* — Gerald McClain
(74) *Attorney, Agent, or Firm* — Klintworth & Rozenblat IP LLP

(57) ABSTRACT

A work vehicle including a work implement having a left mounting pin and a right mounting pin laterally spaced from the left mounting pin and a boom assembly configured to manipulate the work implement. The work vehicle includes first and second holders coupling the work implement to the boom assembly, and each of the holders having a left holder opening and a right holder opening laterally spaced from the respective left holder opening. In a first configuration, the left mounting pin connects to the left holder opening of the first holder and the right mounting pin connects to the right holder opening of the second holder. The first and second holders are identical and interchangeable such that in a second configuration, the left mounting pin connects to the left holder opening of the second holder and the right mounting pin connects to the right holder opening of the first holder.

20 Claims, 10 Drawing Sheets

(56) References Cited

U.S. PATENT DOCUMENTS

| | | | | |
|---|---|---|---|---|
| 5,088,882 | A * | 2/1992 | Lovitt, Jr. | E02F 3/3686 172/273 |
| 5,141,385 | A * | 8/1992 | Tibbatts | E02F 3/3622 172/275 |
| 5,950,735 | A * | 9/1999 | Godbersen | A01B 59/062 172/439 |
| 6,386,821 | B1 | 5/2002 | Schneider | |
| 8,790,063 | B2 | 7/2014 | Kim | |
| 8,936,428 | B1 * | 1/2015 | Page | B66F 9/18 37/403 |
| 2010/0269377 | A1 * | 10/2010 | Osgood | E01H 5/066 37/232 |
| 2011/0116903 | A1 * | 5/2011 | Kim | B66F 9/12 414/723 |
| 2013/0214519 | A1 * | 8/2013 | Theriault | B60R 11/00 280/762 |
| 2016/0076219 | A1 * | 3/2016 | Martinez | A01D 87/0076 414/723 |
| 2017/0370069 | A1 * | 12/2017 | Guggino | E02F 3/3604 |

* cited by examiner

HOLDER FOR COUPLING A WORK IMPLEMENT TO A WORK VEHICLE

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicles, and to a holder for coupling a work implement, such as a bucket, to a work vehicle.

BACKGROUND OF THE DISCLOSURE

In the agriculture, construction and forestry industries, various work machines, such as front loaders, may be utilized in lifting and moving various materials. In certain examples, a front loader may include a work implement, such as a bucket, pivotally coupled by loader arms to the vehicle chassis. One or more hydraulic cylinders move the loader arms and/or the bucket to move the bucket between positions relative to the chassis to lift and move materials.

In certain instances, the bucket is reversibly or removably coupled to the front loader, which enables other work implements to be used with the front loader. In these instances, a right loader arm includes a unique right holder and the left loader arm includes a unique left holder, and the right holder and the left holder are not interchangeable. Generally, due to wear requirements associated with the left and right holders, the left and right holders are made of iron. The use of heavy iron may reduce a rated carrying capacity of the work vehicle.

SUMMARY OF THE DISCLOSURE

The disclosure provides a holder for coupling a work implement, such as a bucket, to the work vehicle such that the same holder is used for both a left loader arm and a right loader arm. The holder is also composed of a lightweight material, which reduces a weight of the holder and may improve a rated carry capacity of the work vehicle.

In one aspect, the disclosure provides a work vehicle including a work implement having a left mounting pin and a right mounting pin laterally spaced from the left mounting pin and a boom assembly configured to manipulate the work implement. The work vehicle includes first and second holders coupling the work implement to the boom assembly, and each of the first and second holders having a left holder opening and a right holder opening laterally spaced from the respective left holder opening. In a first configuration, the left mounting pin connects to the left holder opening of the first holder and the right mounting pin connects to the right holder opening of the second holder. The first and second holders are identical and interchangeable such that in a second configuration, the left mounting pin connects to the left holder opening of the second holder and the right mounting pin connects to the right holder opening of the first holder.

Further provided is a work vehicle. The work vehicle includes a work implement having a left mounting pin and a right mounting pin laterally spaced from the left mounting pin. The work vehicle includes a boom assembly configured to manipulate the work implement. The work vehicle includes first and second holders coupling the work implement to the boom assembly. Each of the first and second holders having a left holder opening and a right holder opening laterally spaced from the respective left holder opening. In a first configuration, the left mounting pin connects to the left holder opening of the first holder and the right mounting pin connects to the right holder opening of the second holder. The first and second holders are identical and interchangeable such that in a second configuration, the left mounting pin connects to the left holder opening of the second holder and the right mounting pin connects to the right holder opening of the first holder.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
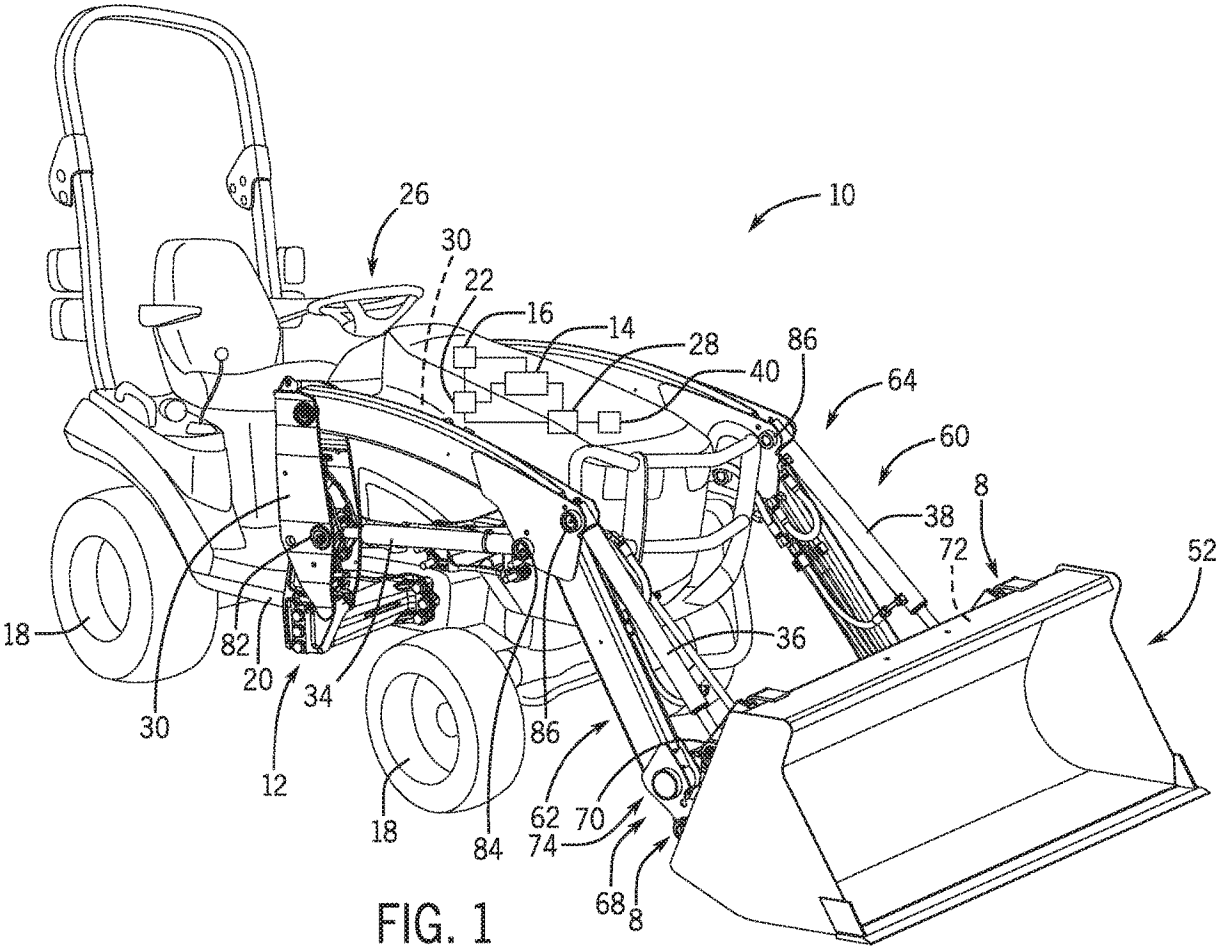
FIG. 1 is a perspective view of an example work vehicle in the form of a tractor having a removable front loader in which the disclosed holder for coupling a work implement may be used to couple a bucket to the front loader.

The following describes one or more example embodiments of the disclosed common holder, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Conventional holders for use in various construction and agricultural applications to couple a work implement to a work vehicle for hauling materials (e.g., dirt, sand, aggregate and so on) are typically cast or fabricated of heavy-duty construction using high-strength materials (e.g., ductile iron). The heavy-duty construction affords conventional holders the ability to undergo extreme lifting and treatment during use. In addition to the material itself, the weight of the heavy-duty holders must be accommodated by the host machine, and may reduce a rated carrying capacity of the host machine. Moreover, generally, a unique right holder is required for a right loader arm and a unique left holder is required for a left loader arm, which increases manufacturing costs associated with conventional holders.

This disclosure provides an alternative to the conventional holders through the use of a common holder that is configured to couple to each of the right and left loader arms and the bucket. The term "common" is used herein to denote that the same holder is used for both the left loader arm and the right loader arm. The disclosed common holder has a light-duty construction, and is composed of generally lightweight materials.

For example, a body of the disclosed common holder is composed of a lightweight material. As used herein "lightweight material" generally denotes a material that has a weight that is less than a weight of iron, such that the common holder has a weight that is less than a weight of a conventional holder. Exemplary lightweight materials include, but are not limited to, aluminum, polymer-based material, glass-fiber reinforced polymer-based materials, carbon-fiber reinforced polymer-based materials, and the like. In one example, the common holder is composed of aluminum and is cast. The common holder generally has a weight that is about 45% to about 50% lighter than a conventional iron holder. In this example, the common holder has a weight of about 3.7 kilograms (kg). This reduces fuel consumption, and may improve a rated carrying capacity of the work vehicle. Further, as the common holder is interchangeable with the right loader arm and the left loader arm, the common holder reduces manufacturing costs. In this way, the disclosed common holder may have both lightweight and low-cost attributes.

In one example, the common holder includes a plurality of bushings, which are composed of steel. The use of the steel bushings relieves stress acting on the common holder, which enables the use of the lightweight material. Generally, the steel bushings are press-fit into the body of the common holder, but it should be noted that the steel bushings may be coupled to the body of the common holder through any suitable technique. In this example, the common holder also includes a bushing composed of a polymer-based material, which is coupled about a first end of the common holder to mate with the work implement, such as a hook of the bucket. The polymer-based material bushing is replaceable once wom, without requiring a replacement of the common holder. This reduces machine downtime, and thereby improves productivity.

Figure 2:
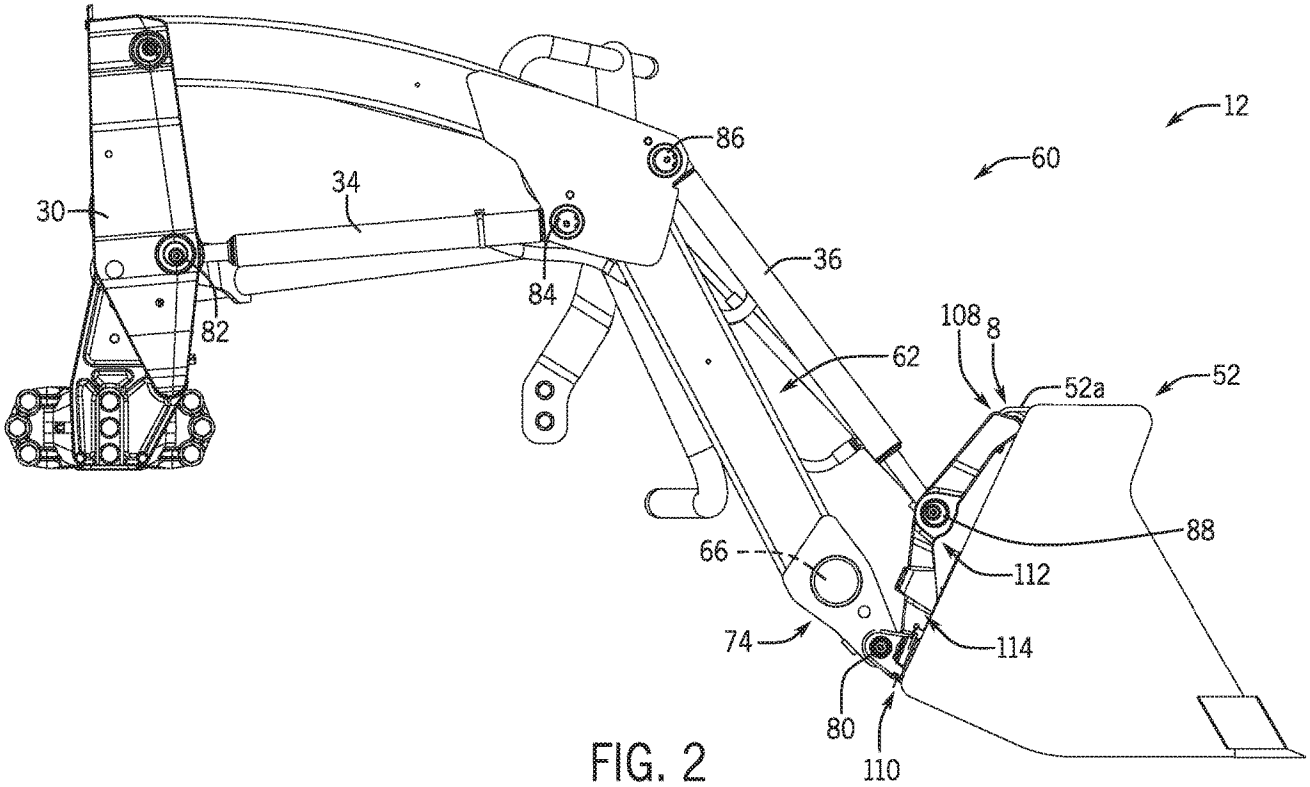
FIG. 2 is a side view of the front loader of FIG. 1, in which the bucket is coupled to the front loader by two of the identical or common holders.

The following describes an example common holder for coupling a work implement, such as a bucket, to a work vehicle. The common holder may be utilized with various machines or work vehicles, including tractors, agricultural loaders and other machines for lifting and moving various materials in the agricultural and construction industries. Referring to FIGS. 1 and 2, in some embodiments, a common holder 8 may be used with a work vehicle, such as a tractor 10, having a front loader 12. In this embodiment, the tractor 10 is a compact utility tractor, and the front loader 12 is removably or reversibly coupled to the tractor 10 via a mounting arrangement 13; however, in other embodiments, such as in the example of the work vehicle as an agricultural loader, the front loader 12 may be fixedly or non-reversibly coupled to the work vehicle. As will be discussed, the holder 8 is interchangeable between a right side and a left side of the front loader 12 associated with the tractor 10, and enables the connection of a work implement to the front loader 12. It will be understood that the implementation of the holder 8 with the front loader 12 associated with the tractor 10 is presented as an example only. Other work vehicles, such as those used in the construction industry, may benefit from the disclosed common holder 8 as well.

Generally, the tractor 10 includes a source of propulsion, such as an engine 14 that supplies power to a transmission 16. In one example, the engine 14 is an internal combustion engine, such as a diesel engine, that is controlled by an engine control module. The transmission 16 transfers power from the engine 14 to a suitable driveline coupled to one or more driven wheels 18 of the tractor 10 to enable the tractor 10 to move. The engine 14, the transmission 16 and the rest of the driveline are supported by a vehicle chassis 20, which is supported off the ground by the wheels 18. As is known to one skilled in the art, the transmission 16 can include a suitable gear transmission, which can be operated in a variety of ranges containing one or more gears, including, but not limited to a park range, a neutral range, a reverse range, a drive range, a low range, a high range, etc. The transmission 16 may be controlled by a transmission control module, which is, along with the engine control module, in communication with a master controller 22 (or group of controllers).

The controller 22 may control various aspects of the operation of the tractor 10 and may be configured as a computing device with associated processor devices and memory architectures, as a hard-wired computing circuit (or circuits), as a programmable circuit, as a hydraulic, electrical or electro-hydraulic controller, or otherwise. As such, the controller 22 may be configured to execute various computational and control functionality with respect to the tractor 10 (or other machinery). In some embodiments, the controller 22 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 22 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 22 may be in electronic, hydraulic, mechanical, or other communication with various other systems or devices of the tractor 10 (or other machinery), including the front loader 12. For example, the controller 22 may be in electronic or hydraulic communication with various actuators, sensors, and other devices within (or outside of) the tractor 10, including various devices associated with a hydraulic system and a hydraulic system of the front loader 12. The controller 22 may communicate with other systems or devices (including other controllers) in various known ways, including via a CAN bus (not shown) of the tractor 10, via wireless or hydraulic communication means, or otherwise. An example location for the controller 22 is depicted in FIG. 1. It will be understood, however, that other locations are possible including other locations on the tractor 10, or various remote locations. In some embodiments, the controller 22 may be configured to receive input commands and to interface with an operator via a human-machine interface 26, which may be disposed for easy access by the operator. The human-machine interface 26 is in communication with the controller 22 over a suitable communication architecture, such as a CAN bus. The human-machine interface 26 may be configured in a variety of ways and may include one or more joysticks, various switches or levers, a steering wheel, one or more buttons, a touchscreen interface that may be overlaid on a display, a keyboard, a speaker, a microphone associated with a speech recognition system, or various other human-machine interface devices.

The tractor 10 also has a hydraulic system that includes one or more pumps and accumulators (designated generally by reference number 28), which may be driven by the engine 14 of the tractor 10. Flow from the pumps 28 may be routed through various control valves and various conduits (e.g., flexible hoses) to drive various hydraulic cylinders, such as hydraulic cylinders 34, 36, 38 associated with the front loader 12, shown in FIG. 1. Flow from the pumps (and accumulators) 28 may also power various other components of the tractor 10. The flow from the pumps 28 may be controlled in various ways (e.g., through control of various electro-hydraulic control valves 40) to cause movement of the hydraulic cylinders 34, 36, 38, and thus, the front loader 12 relative to the tractor 10 when the front loader 12 is mounted on the tractor 10 through a suitable mounting arrangement. In this way, for example, movement of the front loader 12 between various positions relative to the chassis 20 of the tractor 10 may be implemented by various control signals to the pumps 28, control valves 40, and so on. The mounting arrangement may include a mast 30 on each side of the front loader 12 that cooperates with a mounting frame on each side of the tractor 10 to removably couple the front loader 12 to the tractor 10.

Figure 3:
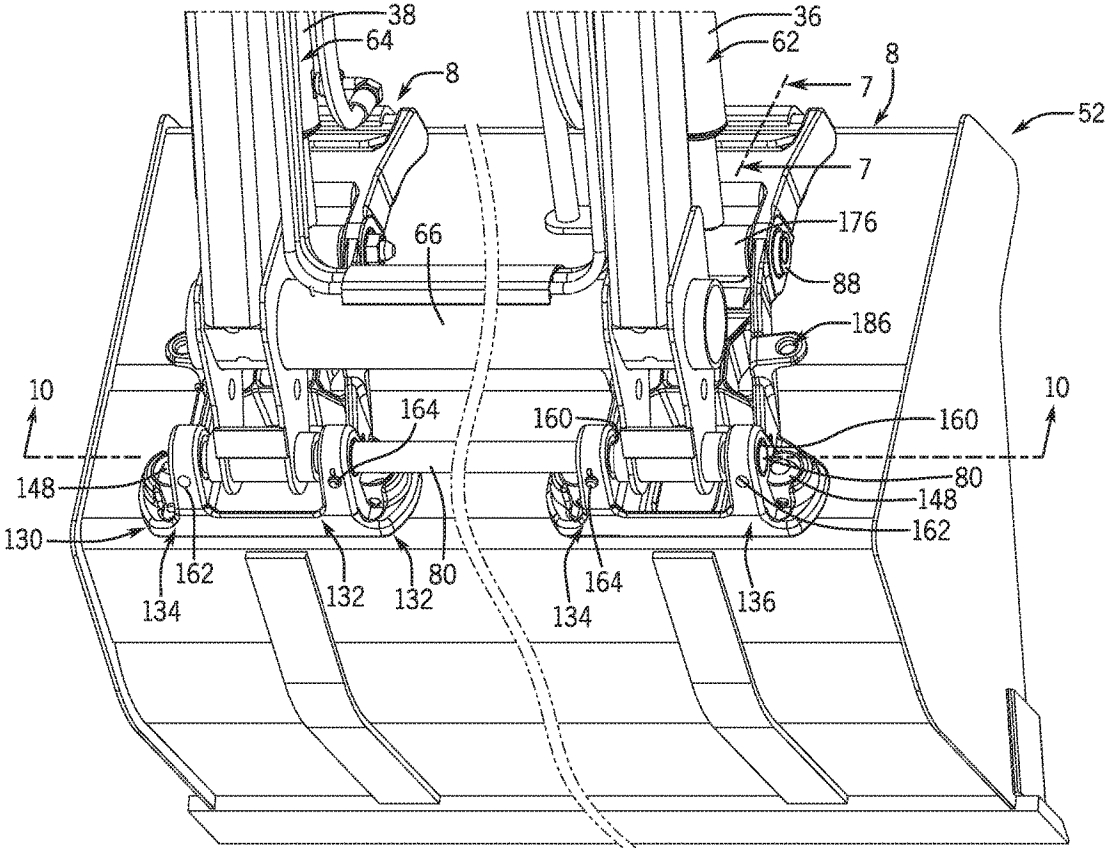
FIG. 3 is a rear perspective view of the bucket, in which one of the common holders is coupled to each of the loader arms and to the bucket.

In the embodiment depicted, the front loader 12 includes a bucket 52 pivotally mounted to a boom assembly 60. The bucket 52 may comprise a conventional steel bucket. The boom assembly 60 includes the first loader arm 62 (on an opposite side of the front loader 12) and the second loader arm 64, which are interconnected via a cross-beam 66 to operate in parallel. The loader arms 62, 64 are each configured to be coupled to the chassis 20 via the mast 30 of the mounting arrangement, at one end, and are coupled at an opposite end to the bucket 52 via a respective one of the holders 8. As will be discussed, each of the holders 8 is mounted to the distal ends of the respective loader arms 62, 64 via a coupling shaft 80 that interconnects the holders 8 (FIG. 3). Additional pins couple the hydraulic cylinders 36, 38 to the loader arms 62, 64 and the respective holders 8. The holders 8 enable pivotal movement of the bucket 52 upon actuation of the hydraulic cylinders 36, 38.

The hydraulic cylinders 34 may be actuated to raise and lower the boom assembly 60 relative to the tractor 10. In the illustrated example, the boom assembly 60 includes two hydraulic cylinders, namely the hydraulic cylinder 34 coupled between a mast 30 of the front loader 12 and the second loader arm 64 and a corresponding cylinder on the opposite side of the loader (not shown) coupled between the mast 30 and the first loader arm 62. It should be noted that the tractor 10 may have any number of hydraulic cylinders, such as one, three, etc. Each of the hydraulic cylinders 34 includes an end coupled to the mast 30 (e.g., via a coupling pin 82) and an end mounted to the respective one of the first loader arm 62 and the second loader arm 64 (e.g., via another pin 84). Upon activation of the hydraulic cylinders 34, the boom assembly 60 may be moved between various positions to elevate the boom assembly 60, and thus the bucket 52, relative to the chassis 20 of the tractor 10.

The one or more hydraulic cylinders 36 are mounted to the first loader arm 62 and the holder 8, and the one or more hydraulic cylinders 38 are mounted to the second loader arm 64 and the holder 8. In the illustrated example, the front loader 12 includes a single hydraulic cylinder 36, 38 associated with a respective one of the first loader arm 62 and the second loader arm 64, respectively. Each of the hydraulic cylinders 36, 38 includes an end mounted to a respective one of the first loader arm 62 and the second loader arm 64 (via a pin 86) and an end mounted to the respective one of the holders 8 (via another pin 88). Upon activation of the hydraulic cylinders 36, 38, the bucket 52 may be moved between various positions, to pivot the bucket 52 relative to the boom assembly 60.

Thus, in the embodiment depicted, the bucket 52 is pivotable by the hydraulic cylinders 36, 38. As noted, in some embodiments, a different number or configuration of hydraulic cylinders or other actuators may be used. Accordingly, it will be understood that the configuration of the hydraulic system and the boom assembly 60 is presented as an example only. In this regard, in other contexts, a hoist boom (e.g. the boom assembly 60) may be generally viewed as a boom that is pivotally attached to a vehicle frame (via the mounting arrangement), and that is also pivotally attached to an end effector (e.g., the bucket 52). Similarly, the holders 8 may be generally viewed as a component effecting pivotal attachment of a bucket (e.g. the bucket 52) to a vehicle frame. In this light, a tilt actuator (e.g., the hydraulic cylinders 36, 38) may be generally viewed as an actuator for pivoting a receptacle with respect to a hoist boom, and the hoist actuator (e.g. the hydraulic cylinders 34) may be generally viewed as an actuator for pivoting a hoist boom with respect to a vehicle frame.

In certain applications, sensors (e.g., pressure, flow or other sensors) may be provided to observe various conditions associated with the tractor 10. For example, the sensors may include one or more pressure sensors that observe a pressure within the hydraulic circuit, such as a pressure associated with at least one of the pumps 28, the control valves 40 and/or one or more hydraulic cylinders 34, 36, 38 to observe a pressure within the hydraulic cylinders and generate sensor signals based thereon. In some cases, various sensors may be disposed on or near the holders 8 and/or the bucket 52. For example, sensors (e.g. inertial measurement sensors) may be coupled on or near the bucket 52 to observe or measure parameters including the acceleration of the boom assembly 60 and/or the bucket 52 and generate sensor signals, which may indicate if the boom assembly 60 and/or the bucket 52 is accelerating or decelerating. In some embodiments, various sensors (e.g., angular position sensors) may be configured to detect the angular orientation of the bucket 52 relative to the boom assembly 60, or to detect the angular orientation of the boom assembly 60 relative to the chassis 20, and various other indicators of the current orientation or position of the bucket 52. For example, rotary angular position sensors may be used or linear position or displacement sensors may be used to determine the length of the hydraulic cylinders 34, 36, 38 relative to the boom assembly 60.

The bucket 52 generally defines a receptacle for carrying various materials, such as dirt, rocks, wet dirt, sand, hay, etc. The bucket 52 is movable upon actuation of the hydraulic cylinders 36, 38 between a level position, a roll-back position and a dump position, along with various positions in between. In the level position, the bucket 52 can receive various materials. In the roll-back position, the bucket 52 is pivoted upward relative to the earth's surface or ground by the actuation of the hydraulic cylinders 36, 38 such that the bucket 52 may be loaded with and retain the various materials. In the dump position, the bucket 52 is pivoted downward relative to the earth's surface or ground by the actuation of the hydraulic cylinders 36, 38 such that the various materials may fall from the bucket 52 to substantially empty the bucket 52.

The holders 8 reversibly or removably couples the bucket 52 to the front loader 12 associated with the tractor 10. Generally, with reference to FIG. 3, the front loader 12 includes two holders 8, one for each side (e.g. left side, right side) of the front loader 12. As the holder 8 on the left side of the front loader 12 is the same as the holder 8 on the right side of the front loader 12, the holder 8 on the right side will be discussed in detail herein, with the understanding that the holder 8 on the left side is the same.

Figure 4:
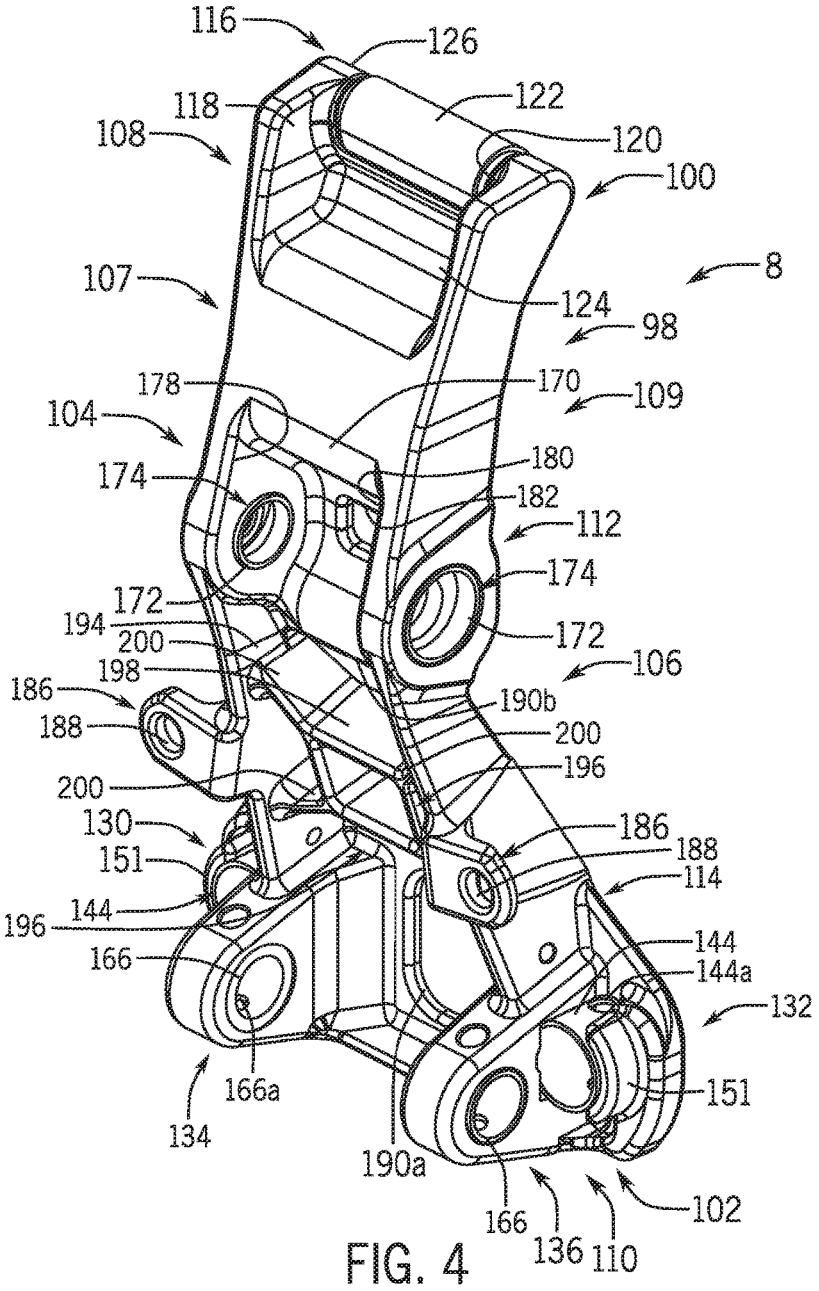
FIG. 4 is a perspective view of the common holder.

In one example, with reference to FIG. 4, the holder 8 is shown in greater detail. The holder 8 is generally symmetric about a longitudinal axis L of the holder 8. The holder 8 includes a body 98 having a first end 100 opposite a second end 102, and a first lateral side 104 opposite a second lateral side 106. The body 98 also has a front side 107 opposite a rear side 109. The holder 8 also includes a first bucket mounting area 108, a second bucket mounting area 110, a cylinder mounting area 112 and a pin retaining area 114. The body 98 of the holder 8 is monolithic, one-piece or integrally formed, and in one example, the body 98 is composed of a lightweight material. In one example, the body 98 is composed of aluminum, and is cast. Generally, the shape of the body 98 of the holder 8 enables the holder 8 to be cast without requiring a core, which reduces manufacturing costs. It should be noted that other materials and techniques may be employed to form the body 98. The front side 107 of the holder 8 is proximate the respective loader arm 62, 64, and the rear side 109 is proximate the bucket 52, when the bucket 52 is coupled to the holder 8.

Figure 6:
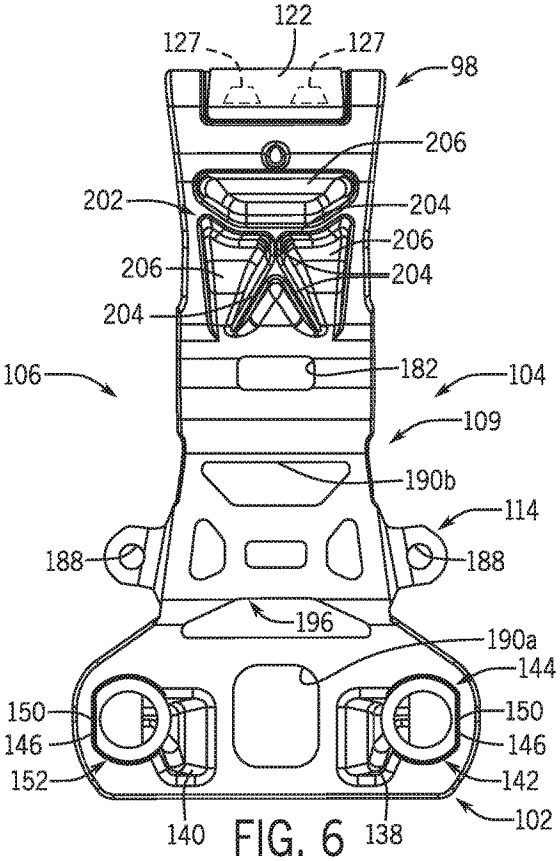
FIG. 6 is a rear view of the common holder.
Figure 5:
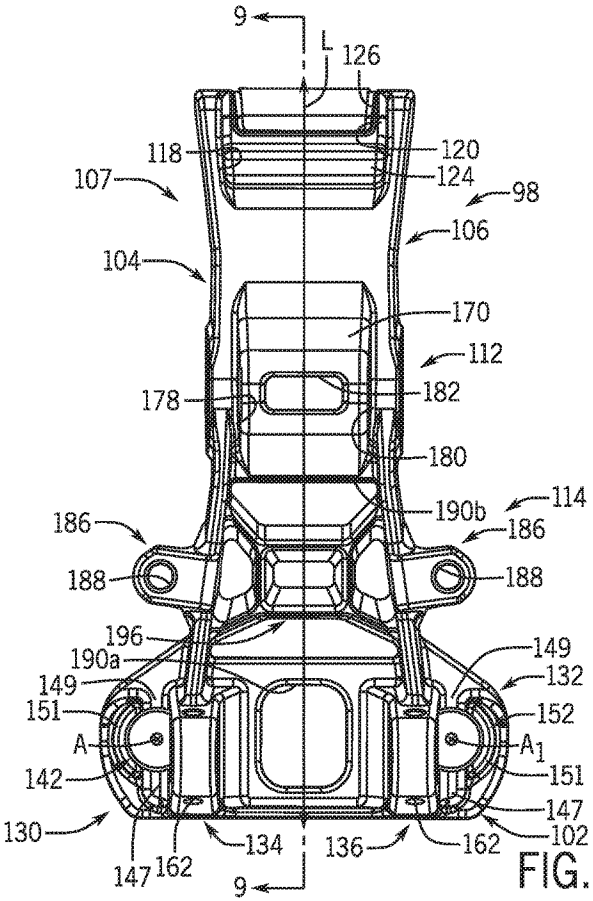
FIG. 5 is a front view of the common holder.
Figure 7:
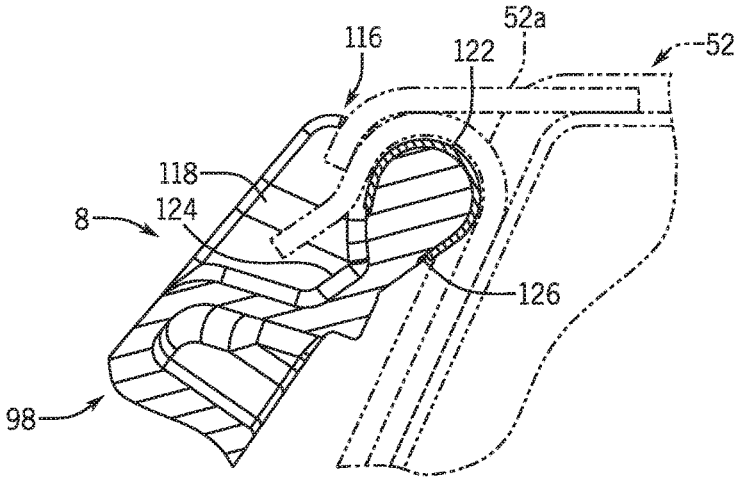
FIG. 7 is a schematic cross-sectional view of a first bucket mounting area of the common holder engaging with a hook of the bucket.

The first bucket mounting area 108 is defined at the first end 100 of the body 98. In one example, the first bucket mounting area 108 includes a receiving channel 116 defined between opposing sidewalls 118, 120, and a bushing 122. With reference to FIGS. 5 and 6, the receiving channel 116 includes a recess 124, a bushing relief 126 and a pair of retaining indents 127 (FIG. 6). The recess 124 is substantially C-shaped, and provides clearance for a hook 52*a* of the bucket 52 (FIG. 7) to engage the first bucket mounting area 108. The sidewall 118 extends along the first side 104, and the sidewall 120 extends along the second side 106 such that the recess 124 and the bushing relief 126 are each defined between the first side 104 and the second side 106. The bushing relief 126 is defined at the first end 100, adjacent to the recess 124. The bushing relief 126 is sized to enable the bushing 122 to be snap-fit onto the first end 100 of the body 98. Generally, the bushing relief 126 is a small C-shaped reduction in material about the first end 100 of the body 98 on both the front side 107 and the rear side 109 for receipt of the bushing 122. Stated another way, the bushing relief 126 is defined as a reduction in material or thickness of the body 98 at the first end 100 that surrounds the first end 100 on both the front side 107 and the rear side 109. Each of the pair of retaining indents 127 is defined within the bushing relief 126, and extends inward into the body 98. In one example, the pair of retaining indents 127 define angled recesses that receive a respective portion of the bushing 122 to securely couple the bushing 122 to the body 98.

The bushing 122 is coupled to the first end 100 so as to surround the first end 100. Generally, the bushing 122 is coupled to the first end 100 such that a portion of the bushing 122 is disposed on the front side 107, and a portion of the bushing 122 is disposed on the rear side 109. The bushing 122 cooperates with the hook 52*a* (FIG. 6) to couple the bucket 52 to the front loader 12 (FIG. 1). The bushing 122 provides wear resistance to the first end 100 of the holder 8 from the coupling of the bucket 52 to the front loader 12 (FIG. 1). In one example, the bushing 122 is composed of a polymer-based material. It should be noted, however, that the bushing 122 may alternatively be composed of a metal, metal alloy or ceramic material. The bushing 122 may be molded, cast, printed, etc. The bushing 122 is C-shaped, and is sized to be press-fit into the bushing relief 126 at the first end 100. In certain embodiments, the bushing 122 includes one or more internal projections that mate with a respective one of the pair of retaining indents 127 to further secure the bushing 122 on the first end 100.

With reference to FIG. 4, the second bucket mounting area 110 is defined at the second end 102 of the body 98. The second bucket mounting area 110 includes a first flange 130, a second flange 132, a first shaft receptacle 134, a second shaft receptacle 136, a first pin clearance 138 (FIG. 6) and a second pin clearance 140 (FIG. 6). The first flange 130 extends outward from the first side 104. The first flange 130 defines a portion of a left holder opening or first bullet pin bore 142, and includes a bullet bushing 144. The first bullet pin bore 142 is generally defined through the first flange 130 and a portion of the first side 104, and is sized to receive the bullet bushing 144. The first bullet pin bore 142 includes a flat or planar sidewall portion 146 (FIG. 6), which assists in the assembly of the holder 8. The first bullet pin bore 142 is defined along an axis A that is substantially perpendicular to the longitudinal axis L.

Figure 4A:
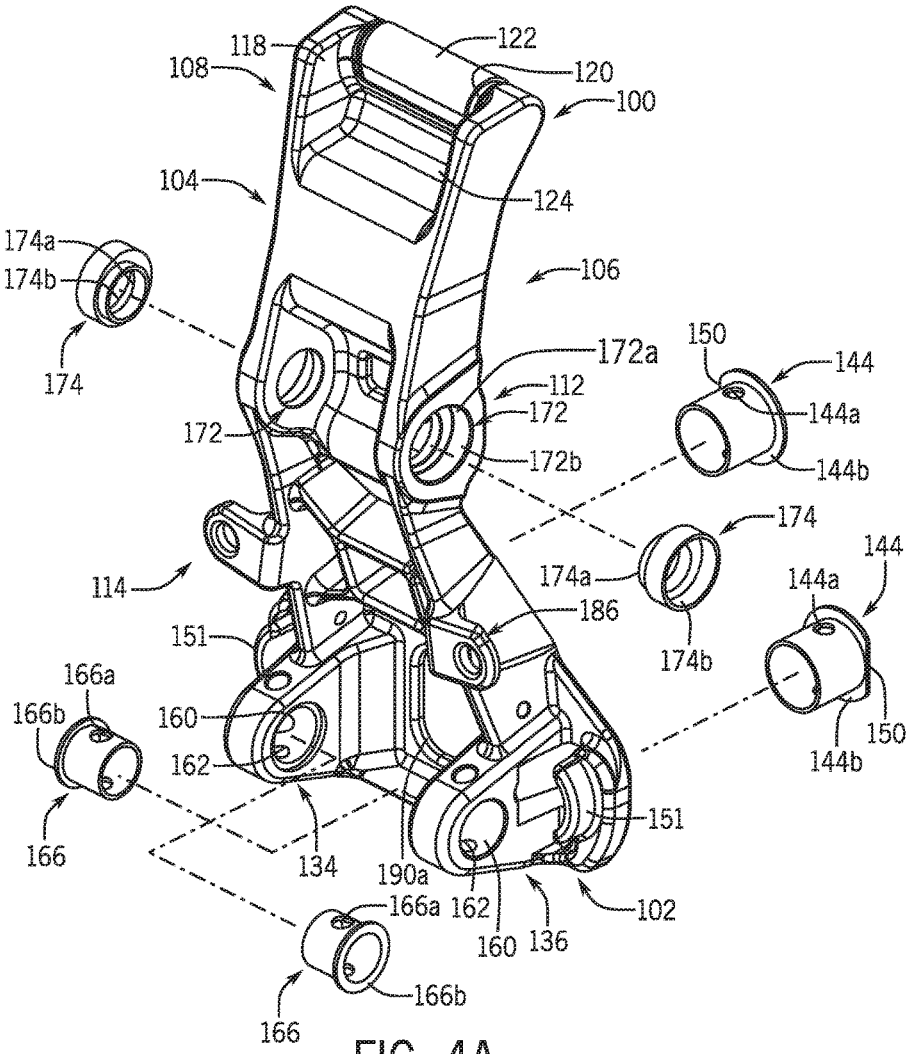
FIG. 4A is a partially exploded view of the common holder of FIG. 4.

The bullet bushing 144 receives a respective one of a left mounting pin and a right mounting pin or a pair of bullet pins 148 of the bucket 52 (FIG. 3) therein. With reference to FIG. 4A, the bullet bushing 144 is substantially cylindrical, and includes a bushing flange 144*b* having a corresponding flat or planar side 150, which cooperates with the planar sidewall portion 146 of the first bullet pin bore 142 (FIG. 6) to assemble the bullet bushing 144 to the holder 8. The bullet bushing 144 also includes a bushing cross-bore 144*a*, which receives a portion of the bullet pin 148 for securing the bullet pin 148 to the holder 8. In one example, the bullet bushing 144 is composed of a metal or metal alloy, such as steel, and is cast, forged, stamped, etc. The bullet bushing 144 is generally press-fit into the holder 8; however, other techniques may be employed, such as adhesives, etc.

The second flange 132 extends outward from the second side 106. The second flange 132 defines a portion of a right holder opening or second bullet pin bore 152, and includes the bullet bushing 144. The second bullet pin bore 152 is generally defined through the second flange 132 and a portion of the second side 106, and is sized to receive the bullet bushing 144. The second bullet pin bore 152 includes the flat or planar sidewall portion 146 (FIG. 6), which assists in the assembly of the holder 8. The second bullet pin bore 152 is defined along an axis A1 that is substantially perpendicular to the longitudinal axis L. The bullet bushing 144 of the second bullet pin bore 152 receives the other one of the pair of bullet pins 148 of the bucket 52 (FIG. 3) therein. The flat or planar side 150 of the bushing flange 144*b* of the bullet bushing 144 cooperates with the planar sidewall portion 146 of the second bullet pin bore 152 to assemble the bullet bushing 144 to the holder 8.

Figure 11:
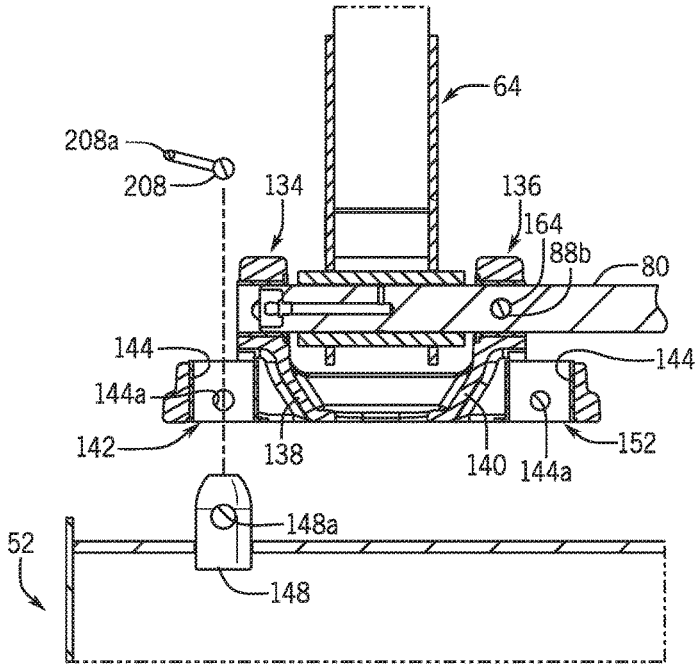
FIG. 11 is an exploded cross-sectional view taken from the perspective of line 10-10 of FIG. 3, which shows the second bucket mounting area of the common holder prior to coupling with a bullet pin of the bucket.

The body 98 may include a pair of first lock pin clearances 147 and a pair of second lock pin clearances 149 defined on opposite sides of a respective one of the first bullet pin bore 142 and the second bullet pin bore 152 to enable a ring lock pin 208 (FIG. 11) to be coupled to the respective bullet pin 148. In this regard, the body 98 may include a partial circular flange 151 defined about only a portion of a perimeter of a respective one of the first bullet pin bore 142 and the second bullet pin bore 152 that cooperates with a ring 208*a* of the ring lock pin 208 (FIG. 11) to enable the ring 208*a* to be positioned about the circular flange 151.

Figure 8:
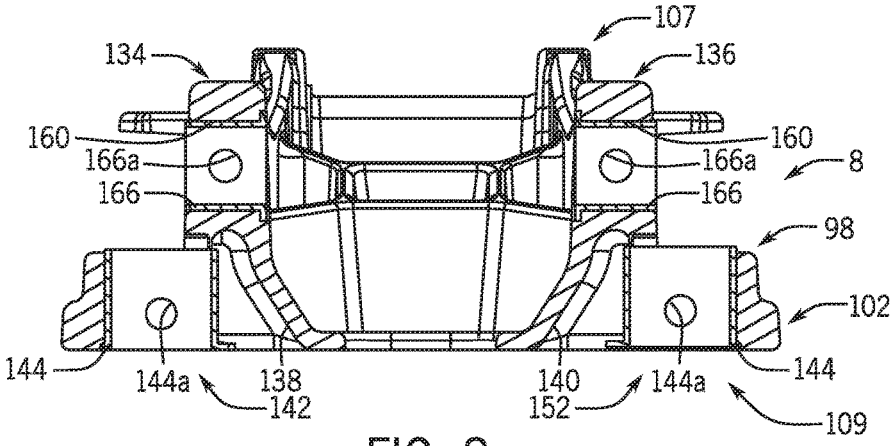
FIG. 8 is a cross-sectional view of a second bucket mounting area of the common holder, taken along line 8-8 of FIG. 9.
Figure 9:
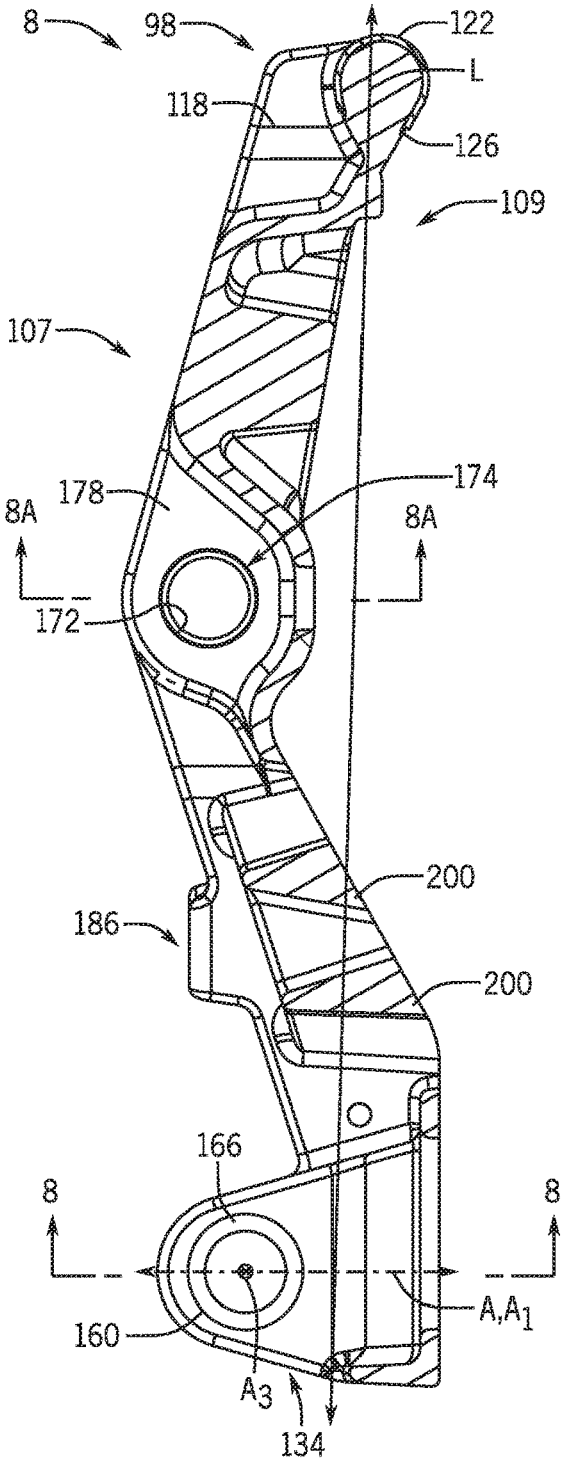
FIG. 9 is a cross-sectional view of the common holder, taken along line 9-9 of FIG. 5.

The first shaft receptacle 134 extends outwardly from the first side 104 of the body 98 at the second end 102. The first shaft receptacle 134 generally extends along an axis that is substantially parallel to the axis A of the first bullet pin bore 142. In one example, the first shaft receptacle 134 defines a shaft bore 160 and a cross-bore 162. The first shaft receptacle 134 also includes a shaft bushing 166. With reference to FIG. 9, the shaft bore 160 has a central axis A3, which is substantially perpendicular to the axes A, A1 and the longitudinal axis L. The shaft bore 160 is sized to receive the coupling shaft 80. With reference to FIG. 8, the cross-bore 162 intersects the shaft bore 160 and is in communication with the shaft bore 160. The cross-bore 162 is sized to receive a lock pin 164 (FIG. 3). As will be discussed, the lock pin 164 passes through a corresponding bore defined in the coupling shaft 80 to couple the coupling shaft 80 to the holder 8.

The shaft bushing 166 is received within the shaft bore 160. The shaft bushing 166 receives the coupling shaft 80 (FIG. 3). The shaft bushing 166 is substantially cylindrical, and includes a bushing cross-bore 166*a*, which cooperates with the cross-bore 162 to receive the lock pin 164. Generally, the bushing cross-bore 166*a* is coaxially aligned with the cross-bore 162 to enable the lock pin 164 to pass through the shaft bore 160. The shaft bushing 166 also includes a bushing flange 166*b*, which assists in coupling the shaft bushing 166 to the shaft bore 160. In one example, the shaft bushing 166 is composed of a metal or metal alloy, such as steel, and is cast, forged, stamped, etc. The shaft bushing 166 is generally press-fit into the holder 8; however, other techniques may be employed, such as adhesives, etc.

The second shaft receptacle 136 extends outwardly from the second side 106 of the body 98 at the second end 102. The second shaft receptacle 136 generally extends along an axis that is substantially parallel to the axis A of the second bullet pin bore 152. In one example, the second shaft receptacle 136 defines the shaft bore 160 and the cross-bore 162. The second shaft receptacle 136 also includes the shaft bushing 166, which is coupled to the shaft bore 160. The shaft bore 160 is sized to receive the coupling shaft 80, and the cross-bore 162 intersects the shaft bore 160 to receive a lock pin 164 to couple the coupling shaft 80 to the holder 8.

With reference to FIG. 6, the first pin clearance 138 is defined as a recessed area on the rear side 109 of the body 98 proximate the second end 102. The first pin clearance 138 is defined inward into the body 98 from the rear side 109 toward the front side 107, and in one example, with reference to FIG. 8, the first pin clearance 138 is partially defined into the first shaft receptacle 134. The first pin clearance 138 is angled within the first shaft receptacle 134 to provide a passageway for receiving the respective one of the pair of bullet pins 148 (FIG. 3), and is in communication with the first bullet pin bore 142. The communication between the first pin clearance 138 and the first bullet pin bore 142 enables one of the pair of bullet pins 148 to be received within the first bullet pin bore 142 and coupled to the holder 8.

The second pin clearance 140 is defined as a recessed area on the rear side 109 of the body 98 proximate the second end 102. The second pin clearance 140 is defined inward into the body 98 from the rear side 109 toward the front side 107, and in one example, the second pin clearance 140 is partially defined into the second shaft receptacle 136. The second pin clearance 140 is angled within the second shaft receptacle 136 to provide a passageway for receiving the respective one of the pair of bullet pins 148 (FIG. 3), and is in communication with the second bullet pin bore 152. The communication between the second pin clearance 140 and the second bullet pin bore 152 enables one of the pair of bullet pins 148 to be received within the second bullet pin bore 152 and coupled to the holder 8. The first pin clearance 138 and the second pin clearance 140 are shaped in such a way that the holder 8 may be cast without cores, which reduces manufacturing costs.

With reference to FIG. 4, the cylinder mounting area 112 is defined between the first end 100 and the second end 102 of the holder 8. The cylinder mounting area 112 includes a cylinder receiving channel 170, a pair of cylinder pin bores 172 and a pair of cylinder pin bushings 174. The cylinder receiving channel 170 receives an end 176 of the respective one of the hydraulic cylinders 36, 38 (FIG. 3). The cylinder receiving channel 170 is a substantially concave recess defined within the front side 107 of the body 98 between a pair of opposing sidewalls 178, 180. The sidewall 178 is defined along the first side 104, and the sidewall 180 is defined along the second side 106. In one example, the cylinder receiving channel 170 terminates in a throughbore 182, which provides a weight savings, however, it will be understood that the throughbore 182 may be optional.

Figure 8A:
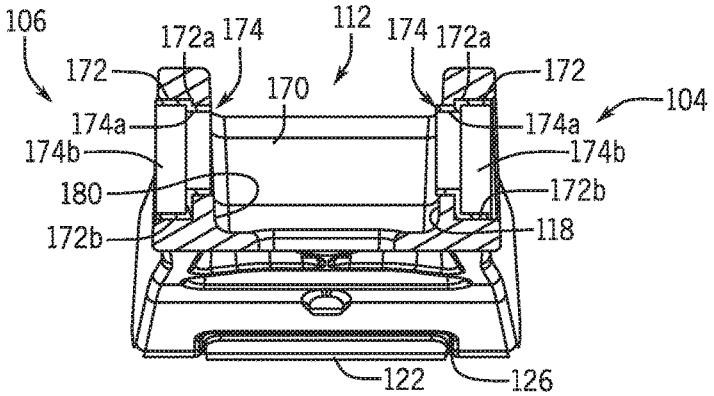
FIG. 8A is a cross-sectional view of a cylinder mounting area of the common holder, taken along line 8A-8A of FIG. 9.

One of the pair of cylinder pin bores 172 is defined through the sidewall 178 on the first side 104, and the other of the pair of cylinder pin bores 172 is defined through the sidewall 180 on the second side 106. In one example, with reference to FIG. 8A, each of the pair of cylinder pin bores 172 includes an internal step 172*a*, which provides clearance for a fastening device, such as a bolt, to be received within a portion 172*b* of each of the pair of cylinder pin bores 172 to couple the pin 88 to the pair of cylinder pin bores 172. The pair of cylinder pin bores 172 each receives a respective one of the cylinder pin bushings 174. Generally, one of the pair of cylinder pin bushings 174 is received within one of the pair of cylinder pin bores 172, and the other of the cylinder pin bushings 174 is received in the other of the pair of cylinder pin bores 172. Each of the pair of cylinder pin bushings 174 includes a stepped diameter 174*a*, which provides clearance for the fastening device, such as the bolt, to be received within a portion 174*b* of each of the pair of cylinder pin bushings 174 having the larger diameter to couple the pin 88 to the pair of cylinder pin bores 172. The stepped diameter 174*a* is offset relative to a central axis of the cylinder pin bushing 174 to inhibit a rotation of the cylinder pin bushing 174. The cylinder pin bushings 174 receive the pin 88 to couple the end 176 of the respective hydraulic cylinder 36, 38 (FIG. 3) to the holder 8. Each of the pair of cylinder pin bushings 174 are composed of metal or metal alloy, including, but not limited to, steel and is cast, forged, stamped, etc. Each of the cylinder pin bushings 174 is generally press-fit into the holder 8; however, other techniques may be employed, such as adhesives, etc. In one example, the pins 88 each include an internally threaded end that receives a bolt and the washer, and the washer interferes with the respective one of the first side 104 and the second side 106 to retain the respective pin 88 within the pair of cylinder pin bores 172.

The pin retaining area 114 is defined on the body 98 between the cylinder mounting area 112 and the second end 102. The pin retaining area 114 includes a pair of pin flanges 186. One of the pin flanges 186 extends outwardly from the first side 104, and the other of the pin flanges 186 extends outwardly from the second side 106. In one example, the pin flanges 186 are angled relative to the respective one of the first side 104 and the second side 106. Each of the pin flanges 186 defines a bore 188, which is sized to receive the lock pin 164 (FIG. 3) when the lock pin 164 is not received within the cross-bore 162 and coupled to the coupling shaft 80.

Additionally, in certain embodiments, the body 98 may include one or more apertures 190 to provide weight savings. In one example, the body 98 includes a first aperture 190*a* and a second aperture 190*b*. The first aperture 190*a* is defined through the body 98 proximate the second end 102. In this example, the first aperture 190*a* is defined between the first shaft receptacle 134 and the second shaft receptacle 136. The first aperture 190*a* is substantially rectangular; however the first aperture 190*a* may have any desired shape.

The second aperture 190*b* is defined between the first side 104 and the second side 106 and is defined between the cylinder mounting area 112 and the second end 102. Generally, the second aperture 190*b* is defined between a pair of opposing sidewalls 192, 194. The sidewall 192 is at the first side 104 and the sidewall 194 is at the second side 106. In this example, the second aperture 190*b* is defined such that the sidewalls 192, 194 act as struts that interconnect the cylinder mounting area 112 with the second end 102. In one example, a reinforcing structure 196 may span the second aperture 190*b* to provide additional strength to the sidewalls 192, 194. In this example, the reinforcing structure 196 includes a central rectangular frame 198, which includes a plurality of support members 200 that interconnect the frame 198 with the respective sidewall 192, 194. Generally, one of the support members 200 extends outwardly from each corner of the frame 198 to interconnect the frame 198 with the respective sidewall 192, 194. It should be noted, however, that the reinforcing structure 196 may have any desired shape.

With reference to FIG. 6, the body 98 may also include one or more reinforcing structures 202 defined on the rear side 109. In this example, the body 98 includes a plurality of interconnected ribs 204. The ribs 204 extend outwardly from the surface of the body 98 on the rear side 109 and reinforce the first bucket mounting area 108. In addition, one or more pockets 206 may be defined adjacent to the ribs 204. The pockets 206 provide for a mass savings and the shape of the pockets 206 increase stiffness of the body 98. The pockets 206 are defined on the rear side 109 to maintain the aesthetic appearance of the front side 107, and are shaped to inhibit the accumulation of dust, sand or other debris.

Generally, with reference to FIGS. 4 and 4A, with the body 98 of the holder 8 formed, via casting, for example, and the bullet bushings 144 formed, one of the bullet bushings 144 is press-fit into each of the first bullet pin bore 142 and the second bullet pin bore 152. With the pair of cylinder pin bushings 174 formed, one of the pair of cylinder pin bushings 174 is press-fit into each of the pair of cylinder pin bores 172. With the bushing 122 formed, the bushing 122 is snap-fit onto the bushing relief 126. This process is repeated to form a second one of the holders 8.

With a pair of holders 8 formed, with reference to FIG. 3, each of the holders 8 is coupled to a respective one of the loader arms 62, 64. In one example, the end 176 of the hydraulic cylinder 36 is coaxially aligned with the pair of cylinder pin bores 172 of one of the holders 8, and the pin 88 is inserted through the pair of cylinder pin bushings 174 to couple the end 176 of the hydraulic cylinder 36 to the holder 8. The end 176 of the hydraulic cylinder 38 is coaxially aligned with the pair of cylinder pin bores 172 of one of the holders 8, and the pin 88 is inserted through the pair of cylinder pin bushings 174 to couple the end 176 of the hydraulic cylinder 38 to the holder 8. In one example, the pins 88 may include the internal threads, which receive the bolt and the washer to retain the pins 88 within the respective pair of cylinder pin bores 172. Alternatively, locking collars, cross-pin or other fastening device may be employed to couple the pins 88 to the respective pair of cylinder pin bores 172.

Figure 10:
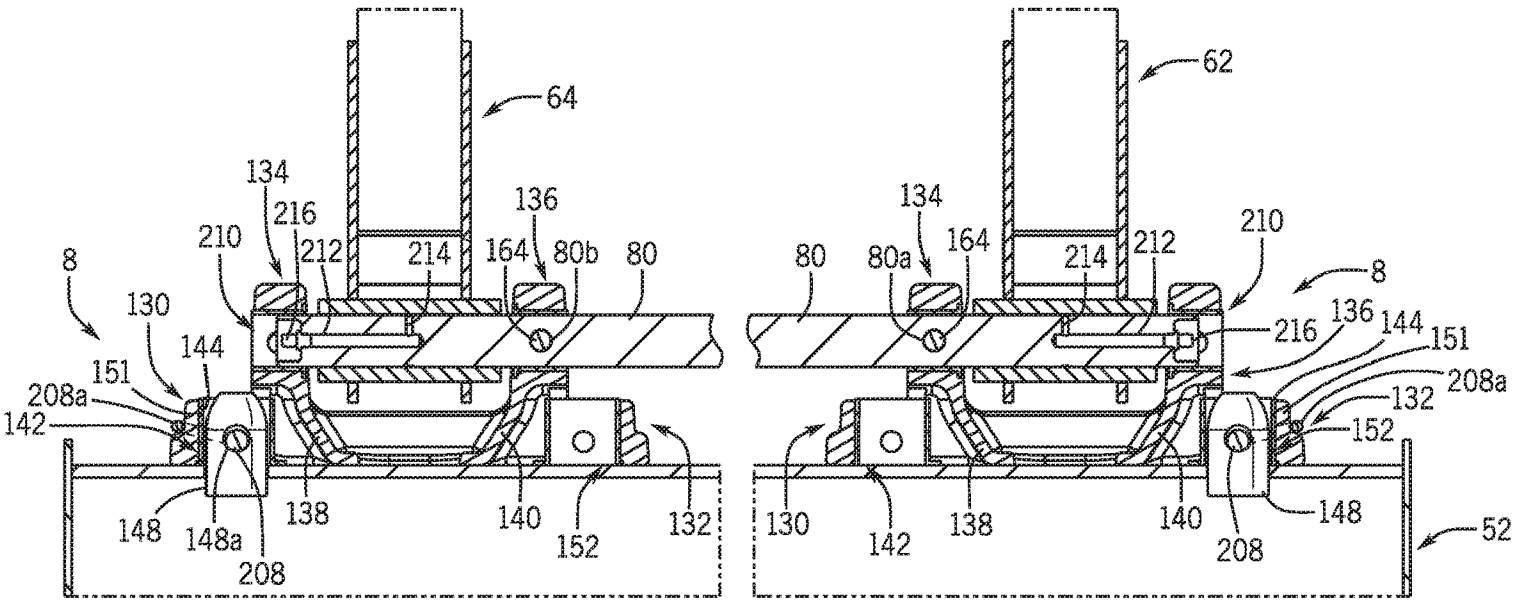
FIG. 10 is a cross-sectional view of two of the common holders coupled to the loader arms and the bucket, taken along line 10-10 of FIG. 3.

The coupling shaft 80 is inserted into the first shaft receptacle 134 and the second shaft receptacle 136 of one of the holders 8. In the example of the holder 8 coupled to the loader arm 62, the coupling shaft 80 is inserted into the shaft bore 160 of the first shaft receptacle 134 and advanced into the shaft bore 160 of the second shaft receptacle 136. In the example of the holder 8 coupled to the loader arm 62, the coupling shaft 80 is coupled to or retained on the holder 8 by the lock pin 164. With reference to FIG. 10, the lock pin 164 is inserted through the cross-bore 162 and the bushing cross-bore 166*a* of the first shaft receptacle 134, and through a first lock pin bore 80*a* of the coupling shaft 80. With reference back to FIG. 3, in the example of the holder 8 coupled to the loader arm 64, the coupling shaft 80 is inserted into the shaft bore 160 of the second shaft receptacle 136 and advanced into the shaft bore 160 of the first shaft receptacle 134. In the example of the holder 8 coupled to the loader arm 64, the coupling shaft 80 is coupled to or retained on the holder 8 by the lock pin 164. With reference to FIG. 10, the lock pin 164 is inserted through the cross-bore 162 and the bushing cross-bore 166*a* of the second shaft receptacle 136, and through a second lock pin bore 80*b* of the coupling shaft 80.

Figure 12:
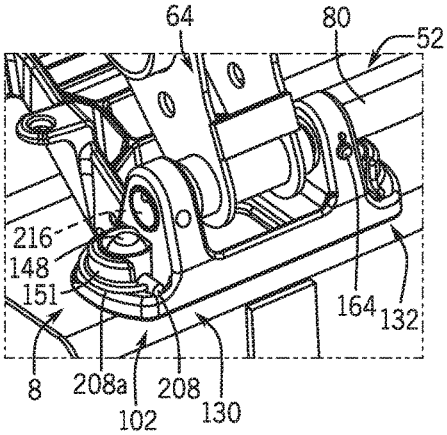
FIG. 12 is a rear perspective view of the common holder coupled to one of the loader arms and to the bucket.
Figure 13:
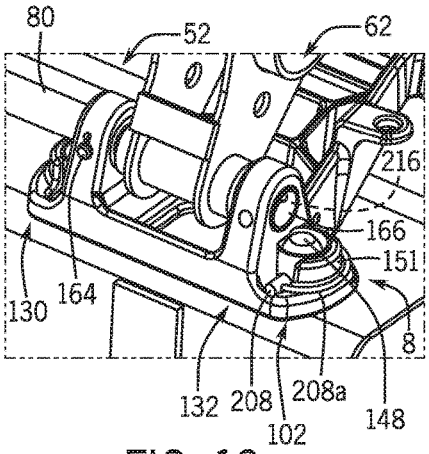
FIG. 13 is a rear perspective view of the common holder coupled to the other one of the loader arms and to the bucket.

With the coupling shaft 80 coupled to the respective holder 8 of each of the loader arms 62, 64, with reference to FIG. 3, the first bucket mounting area 108 is coupled to the hooks 52*a* of the bucket 52. Generally, with reference to FIG. 8, for each holder 8, the holder 8 is pivoted, via the hydraulic cylinders 36, 38, such that the bushing 122 is received within the respective hook 52*a*. With the hooks 52*a* of the bucket 52 coupled to the first bucket mounting area 108 of each of the holders 8, the holders 8 are pivoted, via the hydraulic cylinders 36, 38, such that the second end 102 of the holders 8 is in contact with the bucket 52 and the bullet pins 148 are received within a respective one of the first bullet pin bore 142 and the second bullet pin bore 152. In the example of the holder 8 coupled to the loader arm 62, with reference to FIG. 10, the bullet pin 148 is received within the bullet bushing 144 of the second bullet pin bore 152. The ring lock pin 208 is inserted through a bore 148*a* of the bullet pin 148 and through the bushing cross-bore 144*a* of the bullet bushing 144 to couple the holder 8 to the bullet pin 148, and thus, the bucket 52. With the ring lock pin 208 coupled to the bore 148*a* of the bullet pin 148, the ring 208*a* (FIG. 11) may be positioned about the circular flange 151 to secure the ring lock pin 208 within the bore 148*a* of the bullet pin 148. In the example of the holder 8 coupled to the loader arm 64, with reference to FIG. 10, the bullet pin 148 is received within the bullet bushing 144 of the first bullet pin bore 142. The ring lock pin 208 is inserted through the bore 148*a* of the bullet pin 148 and through the bushing cross-bore 144*a* of the bullet bushing 144 to couple the holder 8 to the bullet pin 148, and thus, the bucket 52. With the ring lock pin 208 coupled to the bore 148*a* of the bullet pin 148, the ring 208*a* may be positioned about the circular flange 151 to secure the ring lock pin 208 within the bore 148*a* of the bullet pin 148. Once the bullet pins 148 are secured to the respective holder 8, the bucket 52 is coupled to the loader arms 62, 64 (FIGS. 12 and 13).

By providing the first pin clearance 138 and the second pin clearance 140 that each receives a portion of the respective bullet pin 148, a lubrication channel 212 of opposed ends 210 of the coupling shaft 80 may be easily accessed by an operator of the tractor 10. In one example, the opposed ends 210 of the coupling shaft 80 includes the lubrication channel 212, and each lubrication channel 212 is in communication with a respective lubrication port 214. The lubrication channel 212 is defined into the respective end 210 for a distance that enables the respective lubrication port 214 to be in communication with a portion of the respective loader arm 62, 64 to lubricate the joint between the respective loader arm 62, 64 and the coupling shaft 80. In one example, the lubrication channel 212 is sealed with a plug 216, which is removable to enable an operator to inject a lubrication fluid into the lubrication channel 212. As each of the bullet pins 148 is disposed partially within the first pin clearance 138 and the second pin clearance 140, the operator may remove the plug 216 without interference from the respective bullet pin 148, as shown in FIGS. 12 and 13.

Also, the following examples are provided, which are numbered for easier reference:

1. A work vehicle including a work implement having a left mounting pin and a right mounting pin laterally spaced from the left mounting pin, and a boom assembly configured to manipulate the work implement, the work vehicle comprising: first and second holders coupling the work implement to the boom assembly, each of the first and second holders having a left holder opening and a right holder opening laterally spaced from the respective left holder opening; wherein, in a first configuration, the left mounting pin connects to the left holder opening of the first holder and the right mounting pin connects to the right holder opening of the second holder; and wherein the first and second holders are identical and interchangeable such that in a second configuration, the left mounting pin connects to the left holder opening of the second holder and the right mounting pin connects to the right holder opening of the first holder.

2. The work vehicle of example 1, wherein each of the first and second holders include a pair of steel bushings, with one of the pair of steel bushings coupled to the left holder opening and the other of the pair of steel bushings coupled to the right holder opening.

3. The work vehicle of example 1, wherein each of the first and second holders include a body composed of a lightweight material, the body having a first end configured to receive a hook of the work implement and a second end opposite the first end, the second end including the left holder opening and the right holder opening.

4. The work vehicle of example 3, wherein each of the first and second holders include a bushing relief defined about the first end of the body, the bushing relief defined on both a front side and a rear side of the body at the first end, each of the first and second holders including a bushing composed of a polymer-based material coupled to the bushing relief so as to surround the front side and the rear side of the body at the first end.

5. The work vehicle of example 3, wherein the body includes a cylinder mounting area defined between the first end and the second end, the cylinder mounting area including a pair of cylinder pin bores and a pair of steel pin bushings, each of the pair of steel pin bushings coupled to a respective one of the cylinder pin bores.

6. The work vehicle of example 5, wherein the body defines an opening between the cylinder mounting area and the second end, and the body includes at least one reinforcing structure that spans the opening.

7. The work vehicle of example 3, wherein the body has a front side opposite a rear side, and includes at least one pin retaining flange that extends outwardly from one of the front side and the rear side.

8. The work vehicle of example 1, wherein each of the first and second holder include a first shaft receptacle and a second shaft receptacle, each of the first shaft receptacle and the second shaft receptacle extending outwardly from the respective one of the first and second holder and defining a shaft bore, the shaft bore configured for receiving a coupling shaft.

9. The work vehicle of example 8, wherein each of the first shaft receptacle and the second shaft receptacle includes a cross-bore that intersects the shaft bore and is configured to receive a lock pin.

10. The work vehicle of example 8, further comprising a pair of steel shaft bushings, with one of the pair of steel shaft bushings received in the shaft bore of the first shaft receptacle and the other of the pair of steel shaft bushings received in the shaft bore of the second shaft receptacle.

11. The work vehicle of example 8, wherein each of the first and second holder has a body having a front side and an opposite rear side, the first shaft receptacle and the second shaft receptacle extend outwardly from the front side, and the body includes a first pin clearance and a second pin clearance defined on the rear side.

12. The work vehicle of example 11, wherein the first pin clearance is defined on the body at least partially inward into the first shaft receptacle and the second pin clearance is defined on the body at least partially inward into the second shaft receptacle.

13. The work vehicle of example 11, wherein the first pin clearance is in communication with the left holder opening and the second pin clearance is in communication with the right holder opening.

The terminology used herein is for the purpose of describing particular embodiments only and is not intended to be limiting of the disclosure. As used herein, the singular forms "a", "an" and "the" are intended to include the plural forms as well, unless the context dearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A work vehicle including a work implement having a left mounting pin and a right mounting pin laterally spaced from the left mounting pin, and a boom assembly configured to manipulate the work implement, the work vehicle comprising:

first and second holders coupling the work implement to the boom assembly, each of the first and second holders having a left holder opening extending along an axis and a right holder opening extending along an axis laterally spaced from the respective left holder opening;

wherein, in a first configuration, the left mounting pin connects to the left holder opening of the first holder and the right mounting pin connects to the right holder opening of the second holder;

wherein the first and second holders are identical and interchangeable such that in a second configuration, the left mounting pin connects to the left holder opening of the second holder and the right mounting pin connects to the right holder opening of the first holder; and wherein the left mounting pin and the right mounting pin each have a transverse bore at an angle relative to the axis of the left mounting pin and axis of the right mounting pin, respectively, that is configured to receive a lock pin that couples the associated one of the first and second holders to the work implement.

2. The work vehicle of claim 1, wherein each of the first and second holders include a pair of steel bushings, with one of the pair of steel bushings coupled to the left holder opening and the other of the pair of steel bushings coupled to the right holder opening.

3. The work vehicle of claim 1, wherein each of the first and second holders includes a body composed of a lightweight material, the body having a first end configured to receive a hook of the work implement and a second end opposite the first end, the second end including the left holder opening and the right holder opening.

4. The work vehicle of claim 3, wherein each of the first and second holders includes a bushing relief defined about the first end of the body, the bushing relief defined on both a front side and a rear side of the body at the first end, each of the first and second holders including a bushing composed of a polymer-based material coupled to the bushing relief so as to surround the front side and the rear side of the body at the first end.

5. The work vehicle of claim 3, wherein the body includes a cylinder mounting area defined between the first end and the second end, the cylinder mounting area including a pair of cylinder pin bores and a pair of steel pin bushings, each of the pair of steel pin bushings coupled to a respective one of the cylinder pin bores.

6. The work vehicle of claim 5, wherein the body defines an opening between the cylinder mounting area and the second end, and the body includes at least one reinforcing structure that spans the opening.

7. The work vehicle of claim 3, wherein the body has a front side opposite a rear side, and includes at least one pin retaining flange that extends outwardly from one of the front side and the rear side.

8. The work vehicle of claim 1, wherein each of the first and second holders includes a first shaft receptacle and a second shaft receptacle, each of the first shaft receptacle and the second shaft receptacle extending outwardly from the respective one of the first and second holders and defining a shaft bore, the shaft bore configured for receiving a coupling shaft.

9. The work vehicle of claim 8, wherein each of the first shaft receptacle and the second shaft receptacle includes a cross-bore that intersects the shaft bore and is configured to receive a lock pin.

10. The work vehicle of claim 8, further comprising a pair of steel shaft bushings, with one of the pair of steel shaft bushings received in the shaft bore of the first shaft receptacle and the other of the pair of steel shaft bushings received in the shaft bore of the second shaft receptacle.

11. The work vehicle of claim 8, wherein each of the first and second holders has a body having a front side and an opposite rear side, the first shaft receptacle and the second shaft receptacle extend outwardly from the front side, and the body includes a first pin clearance and a second pin clearance defined on the rear side.

12. The work vehicle of claim 11, wherein the first pin clearance is defined on the body at least partially inward into the first shaft receptacle and the second pin clearance is defined on the body at least partially inward into the second shaft receptacle.

13. The work vehicle of claim 11, wherein the first pin clearance is in communication with the left holder opening and the second pin clearance is in communication with the right holder opening.

14. A work vehicle, comprising:

a work implement having a left mounting pin and a right mounting pin laterally spaced from the left mounting pin;

a boom assembly configured to manipulate the work implement; and first and second holders coupling the work implement to the boom assembly, each of the first and second holders having a left holder opening extending along an axis and a right holder opening extending along an axis laterally spaced from the respective left holder opening;

wherein, in a first configuration, the left mounting pin connects to the left holder opening of the first holder and the right mounting pin connects to the right holder opening of the second holder;

wherein the first and second holders are identical and interchangeable such that in a second configuration, the left mounting pin connects to the left holder opening of the second holder and the right mounting pin connects to the right holder opening of the first holder; and wherein the left mounting pin and the right mounting pin each have a transverse bore at an angle relative to the axis of the left mounting pin and axis of the right mounting pin, respectively, that is configured to receive a lock pin that couples the associated one of the first and second holders to the work implement.

15. The work vehicle of claim 14, wherein each of the first and second holders include a body composed of a light-weight material, the body having a first end configured to receive a hook of the work implement and a second end opposite the first end, the second end including the left holder opening and the right holder opening, and the body includes a cylinder mounting area defined between the first end and the second end, the cylinder mounting area including a pair of cylinder pin bores and a pair of steel pin bushings, each of the pair of steel pin bushings coupled to a respective one of the cylinder pin bores.

16. The work vehicle of claim 15, wherein each of the first and second holders includes a bushing relief defined about the first end of the body, the bushing relief defined on both a front side and a rear side of the body at the first end, each of the first and second holders including a bushing composed of a polymer-based material coupled to the bushing relief so as to surround the front side and the rear side of the body at the first end.

17. The work vehicle of claim 14, wherein each of the first and second holders includes a pair of steel bushings, with one of the pair of steel bushings coupled to the left holder opening and the other of the pair of steel bushings coupled to the right holder opening.

18. The work vehicle of claim 14, wherein each of the first and second holders includes a first shaft receptacle and a second shaft receptacle, each of the first shaft receptacle and the second shaft receptacle extending outwardly from the respective one of the first and second holders and defining a shaft bore, the shaft bore configured for receiving a coupling shaft and each of the first shaft receptacle and the second shaft receptacle includes a cross-bore that intersects the shaft bore and is configured to receive a lock pin.

19. The work vehicle of claim 18, further comprising a pair of steel shaft bushings, with one of the pair of steel shaft bushings received in the shaft bore of the first shaft receptacle and the other of the pair of steel shaft bushings received in the shaft bore of the second shaft receptacle.

20. The work vehicle of claim 18, wherein each of the first and second holders has a body having a front side and an opposite rear side, the first shaft receptacle and the second shaft receptacle extend outwardly from the front side, the body includes a first pin clearance and a second pin clearance defined on the rear side, and the first pin clearance is in communication with the left holder opening and the second pin clearance is in communication with the right holder opening.

* * * * *